US011486580B2

(12) United States Patent
Caples et al.

(10) Patent No.: US 11,486,580 B2
(45) Date of Patent: Nov. 1, 2022

(54) FLUID NOZZLES AND SPACERS

(71) Applicant: Delavan Inc., West Des Moines, IA (US)

(72) Inventors: Mark A. Caples, Ankeny, IA (US); Andy W. Tibbs, Earlham, IA (US); Patrick Leer, Urbandale, IA (US)

(73) Assignee: Collins Engine Nozzles, Inc., Des Moines, IA (US)

( * ) Notice: Subject to any disclaimer, the term of this patent is extended or adjusted under 35 U.S.C. 154(b) by 121 days.

(21) Appl. No.: 16/752,182

(22) Filed: Jan. 24, 2020

(65) Prior Publication Data

US 2021/0231306 A1 Jul. 29, 2021

(51) Int. Cl.

| | |
|---|---|
| ***F23R 3/28*** | (2006.01) |
| ***F23D 11/12*** | (2006.01) |
| ***F23D 11/36*** | (2006.01) |
| ***F23D 11/38*** | (2006.01) |
| ***F23D 14/46*** | (2006.01) |
| ***F23D 14/48*** | (2006.01) |

(52) U.S. Cl.

CPC ..... *F23R 3/28* (2013.01); *F23D 11/12* (2013.01); *F23D 11/36* (2013.01); *F23D 11/38* (2013.01); *F23D 14/46* (2013.01); *F23D 14/48* (2013.01); *F23R 2900/00005* (2013.01); *F23R 2900/00014* (2013.01)

(58) Field of Classification Search

CPC ..... F02C 7/222; F23R 2900/00005; F23R 3/283; F02M 55/008; F02M 55/04

USPC ..... 431/114

See application file for complete search history.

(56) References Cited

U.S. PATENT DOCUMENTS

| | | | | |
|---|---|---|---|---|
| 6,098,407 | A * | 8/2000 | Korzendorfer | F23C 7/002 60/737 |
| 6,351,948 | B1 | 3/2002 | Goeddeke | |
| 6,761,035 | B1 * | 7/2004 | Mueller | F02C 7/22 239/397.5 |
| 2002/0069647 | A1 | 6/2002 | Mayersky et al. | |
| 2007/0039325 | A1 * | 2/2007 | Lehtinen | F23R 3/28 60/740 |
| 2011/0167830 | A1 | 7/2011 | Bishara et al. | |
| 2018/0058404 | A1 | 3/2018 | Tibbs | |
| 2018/0266693 | A1 * | 9/2018 | Patel | F23R 3/343 |
| 2019/0292987 | A1 | 9/2019 | Goeddeke et al. | |

OTHER PUBLICATIONS

European Search Report issued in corresponding EP Patent Application No. 21152597.7 dated Jun. 1, 2021. (6 pages).

* cited by examiner

*Primary Examiner* — Vivek K Shirsat

(74) *Attorney, Agent, or Firm* — Locke Lord LLP; Daniel J. Fiorello; Gabrielle Gelozin

(57) ABSTRACT

A spacer for a fluid nozzle can include a body configured to fit within a sheath of the fluid nozzle such that a fluid tube positioned within the sheath is held bent over its longitudinal dimension by the body thereby altering a natural frequency of the fuel tube compared to if the fuel tube were not held bent.

17 Claims, 3 Drawing Sheets

FLUID NOZZLES AND SPACERS

FIELD

This disclosure relates to fluid nozzles, e.g., for use as fuel injectors.

BACKGROUND

Certain fluid nozzles, e.g., fuel injectors for gas turbine engines, are subjected to system vibration, e.g., engine vibration, during operation. Certain fluid nozzle designs incorporate a fluid carrying tube that is attached at one or both ends to the injector support structure. This results in the tube acting as a simply supported beam. This tube design often has a vibration natural frequency that can be excited by engine operational vibration. The resulting tube vibration can result in tube braze/weld joint high cycle fatigue failure.

To reduce the tube vibration amplitude, some designs in the past have added a spacer component. This spacer is usually brazed to the inner tube, but not to the outer tube. Brazing the spacer disc to the outer tube is often not an option, for example, if the outer tube is significantly hotter than the inner in operation. This spacer limits the radial distance of travel, thus reducing the bending stresses at the braze joint. However, the additional component weight reduces the natural frequency of the inner tube and still allows vibration and relative motion, so there is still a risk of wear.

Such conventional methods and systems have generally been considered satisfactory for their intended purpose. However, there is still a need in the art for improved fluid nozzles and spacers and the present disclosure provides a solution for this need.

SUMMARY

A spacer for a fluid nozzle can include a body configured to fit within a sheath of the fluid nozzle such that a fluid tube positioned within the sheath is held bent over its longitudinal dimension by the body thereby altering a natural frequency of the fuel tube compared to if the fuel tube were not held bent. The space can include an off-center hole defined through the body at least in an orthogonal direction to a plane that is coplanar with the body. The off-center hole can be configured to receive a fluid tube within the sheath of the fluid nozzle to bend the fluid tube within the sheath.

The body can be a disk. The off-center hole can be symmetrically shaped. The off-center hole may not be aligned with a center of the disk such that an axis defining a center of the off-center hole and an axis defining the center of the disk are separated from each other in a radial direction.

In certain embodiments, body may include one or more features configured to reduce a weight of the disk. The body can be made of a nickel alloy or stainless steel, or any other suitable material.

In accordance with at least one aspect of this disclosure, a fluid nozzle (e.g., a fuel injection nozzle) can include a sheath, a nozzle base, a nozzle tip, a fluid tube configured to be contained within the sheath and supported at the nozzle base and the nozzle tip, and at least one spacer disposed within the sheath such that the fluid tube is held bent over its longitudinal dimension thereby altering a natural frequency of the fuel tube compared to if the fuel tube were not held bent. In certain embodiments, the at least one spacer can be disposed such that the spacer contacts an inner wall of the sheath and the fluid tube passes through the spacer. The spacer can be configured to bend the fluid tube within the sheath to modify a vibrational characteristic of the fluid tube. In certain embodiments, the fluid tube can be center mounted in the sheath at the nozzle base and the nozzle tip.

The at least one spacer can be any suitable embodiment of a spacer disclosed herein, e.g., as described above. In certain embodiments, the outer shape of the spacer can be the same shape as the inner wall of the sheath (e.g., cylindrical).

The sheath can have a cylindrical tube shape. Any other suitable shape for the sheath is contemplated herein.

At least one spacer can be disposed at about a middle of the fluid tube along a length of the fluid tube. Any other suitable position is contemplated herein. In certain embodiments, the nozzle can further include one or more centered spacers having a centered hole. Each centered spacer can be disposed apart from the at least one spacer (with the off-center hole) along a length of the fluid tube within the sheath.

In accordance with at least one aspect of this disclosure, a method can include bending a fluid tube of a nozzle within a sheath of the nozzle, and modifying a vibrational characteristic of the fluid tube. The method can include installing a bending spacer within the sheath to cause the bending of the fluid tube. The method can include any other suitable method(s) and/or portion(s) thereof are contemplated herein.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
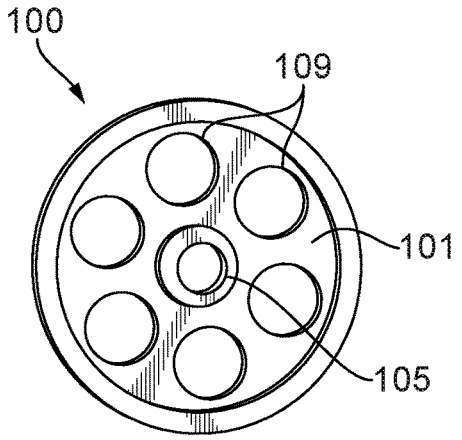
FIG. 1 is a perspective view of an embodiment of a spacer in accordance with this disclosure.

Reference will now be made to the drawings wherein like reference numerals identify similar structural features or aspects of the subject disclosure. For purposes of explanation and illustration, and not limitation, an illustrative view of an embodiment of a spacer in accordance with the disclosure is shown in FIG. 1 and is designated generally by reference character 100. Other embodiments and/or aspects of this disclosure are shown in FIGS. 2-5. Certain embodiments described herein can be used to provide vibration resistant fluid tubes (e.g., fuel injectors for turbomachines).

Figure 2:
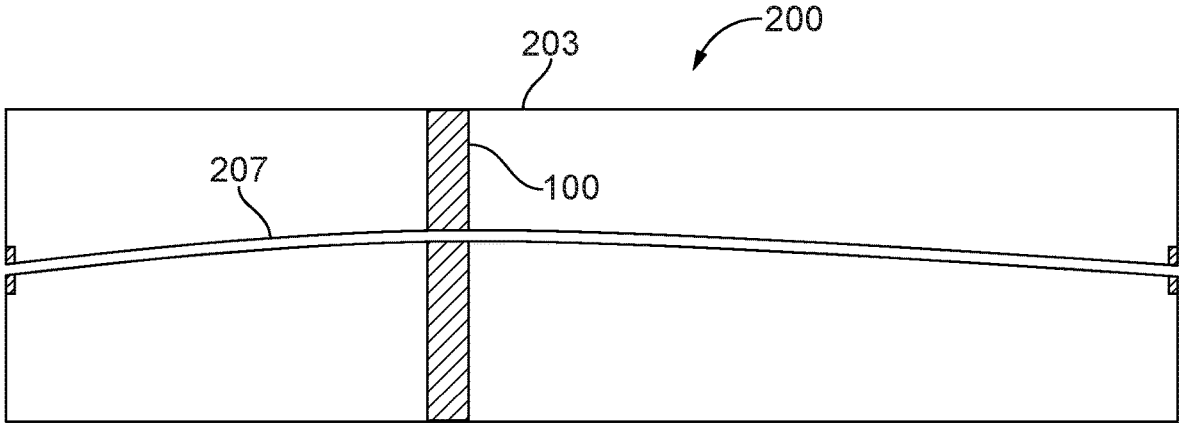
FIG. 2 is a cross-sectional view of an embodiment of a fluid nozzle in accordance with this disclosure, shown having a bent fluid tube supported by the spacer of FIG. 1.

Referring to FIGS. 1 and 2, a spacer 100 for a fluid nozzle 200 can include a body 101 configured to fit within a sheath 203 of the fluid nozzle 200. The body 101 configured such that a fluid tube 207 positioned within the sheath is held bent over its longitudinal dimension by the body 101 thereby altering a natural frequency of the fuel tube 207 compared to if the fuel tube 207 were not held bent. In certain embodiments, the spacer 100 can include an off-center hole 105 defined through the body 101 at least in an orthogonal direction to a plane that is coplanar with the body 101. The off-center hole 105 can be configured to receive a fluid tube 207 within the sheath 200 of the fluid nozzle 200 to bend the fluid tube 207 within the sheath 203.

The body 101 can be a planar shaped body in certain embodiments. For example, the body 101 can be a disk (e.g., a planar circular body as shown). Any other suitable shape is contemplated herein.

The off-center hole 105 can be symmetrically shaped (e.g., a circular hole as shown). Any other suitable shape is contemplated herein. Being off-center can be such that the off-center hole 105 may not be aligned with a center of the disk such that an axis defining a center of the off-center hole 105 and an axis defining the center of the disk are separated from each other in a radial direction. The further away from the center, a great force can be applied to the tube 207, for example (e.g., where the tube 207 is centered).

In certain embodiments, body 101 may include one or more weight reduction features 109 (e.g., holes, removed material portions, etc.) configured to reduce a weight of the disk, and/or to allow fluid flow through the disk. The body 101 can be made of a nickel alloy or stainless steel, or any other suitable material.

Figure 3:
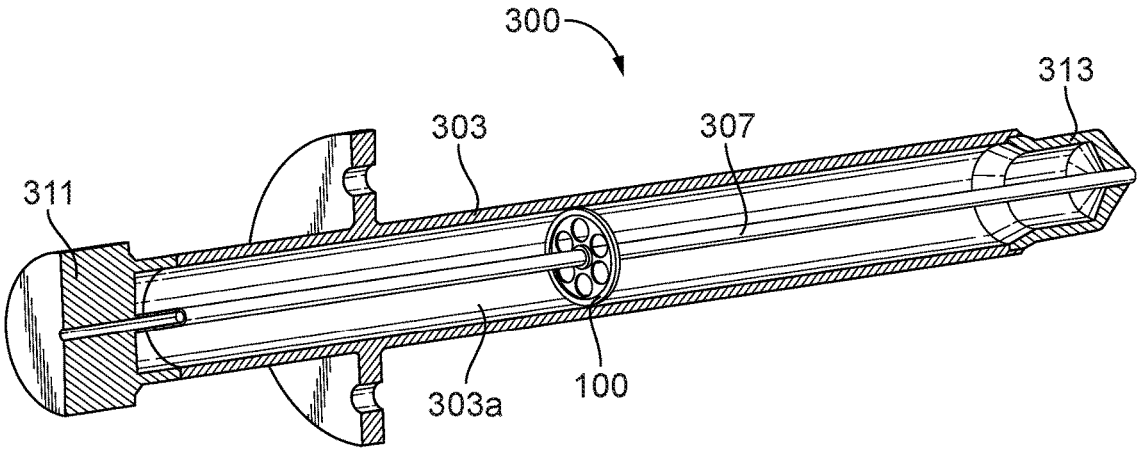
FIG. 3 is a cross-sectional perspective view of an embodiment of a fluid nozzle in accordance with this disclosure, showing the spacer of FIG. 1 disposed therein.

Referring additionally to FIG. 3, in accordance with at least one aspect of this disclosure, a fluid nozzle 300 (e.g., a fuel injection nozzle) can include a sheath 303, a nozzle base 311, a nozzle tip 313, a fluid tube 307 configured to be contained within the sheath 303 and supported at the nozzle base 311 and the nozzle tip 313. The fluid nozzle 300 can include at least one spacer 100 disposed within the sheath 303 such that the fluid tube is held bent over its longitudinal dimension thereby altering a natural frequency of the fuel tube compared to if the fuel tube were not held bent. In certain embodiments, the spacer 100 can contact an inner wall 303*a* of the sheath 303 and the fluid tube 307 passes through the spacer 100. The spacer 100 can be configured to bend the fluid tube 307 (slight bend shown in FIG. 3) within the sheath 300 to modify a vibrational characteristic (e.g., natural frequency) of the fluid tube 307 (e.g., to increase the first mode fundamental/resonant frequency of the fluid tube 307).

In certain embodiments, the fluid tube 307 can be center mounted in the sheath 303 at the nozzle base 311 and the nozzle tip 313, e.g., as shown. In certain embodiments, any other suitable mounting of the fluid tube 307 at the ends thereof is contemplated herein, as long as the spacer 100 is designed to impart a bend on the fluid tube 307.

The at least one spacer 100 can be any suitable embodiment of a spacer disclosed herein, e.g., as described above, for example. In certain embodiments, the outer shape (e.g., the outer diameter of the body 101) of the spacer 100 can be the same shape as the inner wall 303*a* of the sheath 303 (e.g., cylindrical).

The sheath 303 can have a cylindrical tube shape (e.g., along at least a portion of the length of the sheath 303 as shown), for example. Any other suitable shape for the sheath 303 is contemplated herein.

In certain embodiments, the tube 307 can be inserted at the tip 313 and brazed at the base 311. The tube 307 can be brazed at both ends in certain embodiments, or attached in any other suitable way.

The at least one spacer 100 can be disposed at about a middle of the fluid tube 307 along a length of the fluid tube 307, for example. Any other suitable position is contemplated herein. The fluid nozzle 300 can include any other suitable number of spacers 100 with off-center holes 105 (e.g., a plurality spaced evenly or unevenly along the length of the fluid tube 307).

Figure 4:
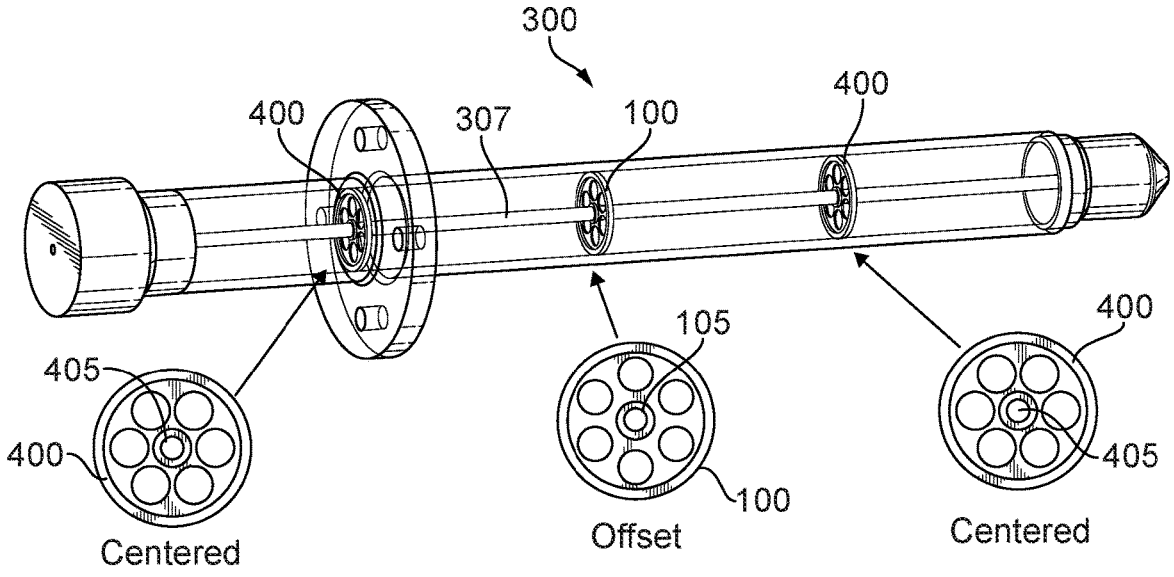
FIG. 4 is perspective view of the embodiment of a fluid nozzle of FIG. 3, shown having three spacers disposed therein.

In certain embodiments, referring additionally to FIG. 4, the nozzle 300 can further include one or more centered spacers 400 (e.g., a spacer that does not cause bending of the fluid tube 307) having a centered hole 405 (e.g., that is aligned with the mount points of tube 307 at the base and tip thereof such that it does not cause bending). Each centered spacer 400 can be disposed apart from the at least one spacer 100 (with the off-center hole 105) along a length of the fluid tube 307 within the sheath 303.

For example, as shown, the spacer 100 can be placed about centered along the length of the fluid tube 307 and the centered spacers 400 can be disposed closer to the base 311 and tip 313 (e.g., such that spacer is between a plurality of centered spacers 400). While two centered spacers 400 and one spacer 100 is shown in FIG. 4, and suitable number of either spacer 100, 400 is contemplated herein. Having one or more centered spacers 400 between a joint (e.g., a braze) and a spacer 100 can reduce the bend stress at the joint.

Figure 5:
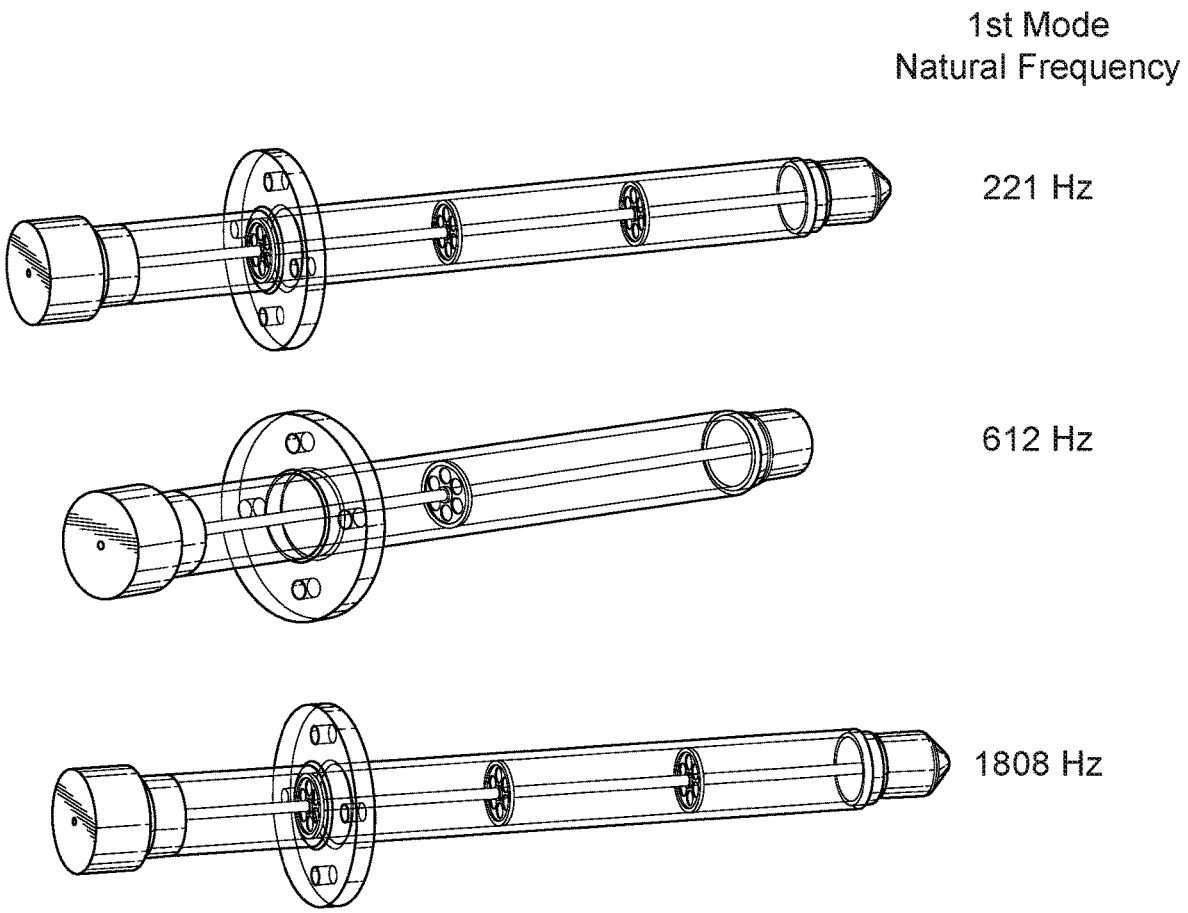
FIG. 5 shows a comparison of a 1st mode natural frequency of various embodiments in accordance with this disclosure.

Referring additionally to FIG. 5, as a result of the radial force created by the offset, the natural frequency increases. The design and placement of the one or more spacers can be selected to raise the natural frequency to a selected value (e.g., outside of an operating range of an engine, e.g., above an engine frequency). In certain embodiments, this value can be about 500 Hz or higher for small high speed turbine. In certain embodiments, even if the higher frequency is reached, the radial force applied by the spacer 100 to the tube 307 can be selected to be greater than force (e.g., amplitude) of the harmonic vibration (e.g., on the order of a few pounds).

As shown in FIG. 5, a natural frequency comparison is shown between a nozzle having no spacer, a nozzle having a single spacer, e.g., as shown in FIG. 3, and a nozzle of FIG. 4 with multiple spacers. The third embodiment shown can have three times the sideload in the center spacer as the second embodiment, and one half of the stress in the braze joint at the base 311, for example.

In accordance with at least one aspect of this disclosure, a method can include bending a fluid tube of a nozzle within a sheath of the nozzle, and modifying a vibrational characteristic of the fluid tube. The method can include installing a bending spacer within the sheath to cause the bending of the fluid tube. The method can include any other suitable method(s) and/or portion(s) thereof are contemplated herein.

Embodiments include an off-centered hole in a spacer which causes bending of the tube when installed, which causes it to push against the wall. The amount of off-center of the hole can be selected to produce predetermined amount of force against the outer wall, and/or to a preselected maximum stress (e.g., 10 ksi). Embodiments can be spaced and selected in any suitable way to control stress, natural frequency, and radial force, for example. Embodiments of a spacer can have less than an inch, e.g. a quarter inch diameter, can be elliptical shape or any other shape that matches whatever the sheath shape is, can be a stainless steel or nickel based alloy, and/or can have an offset hole diameter of about 60 thousands of an inch to about 300 thousandths of an inch. Any other suitable features are contemplated herein.

Embodiments can be used for any fluid nozzles. For example, certain embodiments can be used for fuel injection nozzles (e.g., for turbomachines).

Embodiments force a small bend in a fuel tube and press the spacer against the sheath. The stresses in a fuel tube braze joint can be kept below 10 ksi, are steady state, and not subject to failures because the vibrations are arrested and the spacer disk is not bonded to the sheath, so it is free to slide in response to thermal growths. A combination of spacers (with and without offsets) can be used to achieve various amounts side-loads and minimize the stress in the braze joint.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A spacer for a fluid nozzle, comprising:

a body configured to fit within a sheath of the fluid nozzle such that a fluid tube positioned within the sheath is held bent over its longitudinal dimension by the body thereby altering a natural frequency of the fuel tube compared to if the fuel tube were not held bent; and an off-center hole defined through the body at least in an orthogonal direction to a plane that is coplanar with the body, wherein the off-center hole is configured to receive a fluid tube within the sheath of the fluid nozzle to bend the fluid tube within the sheath, wherein the off-center hole is closer to a center of the body than a radially outer diameter of the body.

2. The spacer of claim 1, wherein the body is a disk, wherein the off-center hole is symmetrically shaped.

3. The spacer of claim 2, wherein the off-center hole is not aligned with a center of the disk such that an axis defining a center of the off-center hole and an axis defining the center of the disk are separated from each other in a radial direction.

4. The spacer of claim 3, further comprising one or more weight reduction features configured to reduce a weight of the disk.

5. The spacer of claim 4, wherein the body is made of a nickel alloy or stainless steel.

6. A fluid nozzle, comprising:

a sheath;

a nozzle base;

a nozzle tip;

a fluid tube configured to be contained within the sheath and supported at the nozzle base and the nozzle tip; and at least one spacer disposed within the sheath such the fluid tube is held bent over its longitudinal dimension thereby altering a natural frequency of the fuel tube compared to if the fuel tube were not held bent, the spacer further comprising:

a body configured to fit within the sheath of the fluid nozzle; and an off-center hole defined through the body at least in an orthogonal direction to a plane that is coplanar with the body, wherein the off-center hole is configured to receive the fluid tube within the sheath of the fluid nozzle to bend the fluid tube within the sheath, wherein the off-center hole is closer to a center of the body than a radially outer diameter of the body.

7. The nozzle of claim 6, wherein the spacer contacts an inner wall of the sheath and the fluid tube passes through the spacer, wherein the spacer is configured to bend the fluid tube within the sheath to modify a vibrational characteristic of the fluid tube, wherein the fluid tube is mounted centrally within the sheath at the nozzle base and the nozzle tip.

8. The nozzle of claim 6, wherein the body is a disk.

9. The nozzle of claim 8, wherein the off-center hole is symmetrically shaped.

10. The nozzle of claim 9, wherein the off-center hole is not aligned with a center of the disk such that an axis defining a center of the off-center hole and an axis defining the center of the disk are separated from each other in a radial direction.

11. The nozzle of claim 10, further comprising one or more weight reduction features configured to reduce a weight of the disk.

12. The nozzle of claim 11, wherein the body is made of a nickel alloy or stainless steel.

13. The nozzle of claim 6, wherein an outer shape of the spacer is the same shape as the inner wall of the sheath.

14. The nozzle of claim 6, wherein the sheath has a cylindrical tube shape.

15. The nozzle of claim 6, wherein the at least one spacer is disposed near a longitudinal center of the fluid tube.

16. The nozzle of claim 15, further comprising one or more centered spacers having a centered hole, each centered spacer disposed apart from the at least one spacer along a length of the fluid tube within the sheath.

17. The spacer of claim 4, wherein the one or more weight reduction holes are positioned radially outward of the off-center hole.

* * * * *